United States Patent [19]

Elkins

[11] Patent Number: 4,535,489

[45] Date of Patent: Aug. 20, 1985

[54] DECORATIVE BATHTUB

[76] Inventor: Carol M. Elkins, 4728 Elliot Ave., S., Minneapolis, Minn. 55407

[21] Appl. No.: 559,388

[22] Filed: Dec. 8, 1983

[51] Int. Cl.[3] ..... A61H 3/02

[52] U.S. Cl. ..... 4/546; 4/538; 4/584

[58] Field of Search ..... 4/538, 580, 584, 546, 4/661, 556, 487, 539

[56] References Cited

U.S. PATENT DOCUMENTS

| | | | |
|---|---|---|---|
| D. 49,658 | 9/1916 | Papp | 4/539 |
| 4,126,719 | 11/1978 | Koyanagi et al. | 4/538 X |
| 4,267,609 | 5/1981 | Altman et al. | 4/584 X |
| 4,364,132 | 12/1982 | Robinson | 4/546 |

*Primary Examiner*—Henry K. Artis

*Attorney, Agent, or Firm*—Merchant, Gould Smith, Edell Welter & Schmidt

[57] ABSTRACT

The subject of the patent application is a bathtub (10) having a bathing compartment or tub (11) including front, rear and side walls (12, 18, 14 and 16 respectively) and a transparent bottom wall (20). The transparent bottom wall (20) is positioned such that it can be illuminated from below. Beneath the transparent bottom wall (20) is located a light source (26) and optionally other decorative elements (30). The decorative elements (30) can be supported on a translucent tray (32) which is positioned beneath the transparent bottom wall (20) but above the light source (26). The area (42) beneath the transparent bottom wall (20) of the tub (11) can be enclosed, and provided with a door (52) for access to the decorative elements (30) and light source (26). The tray (32) can be slidable on a track (34) for easy removal from beneath the transparent bottom wall (20).

9 Claims, 3 Drawing Figures

FIG. 1
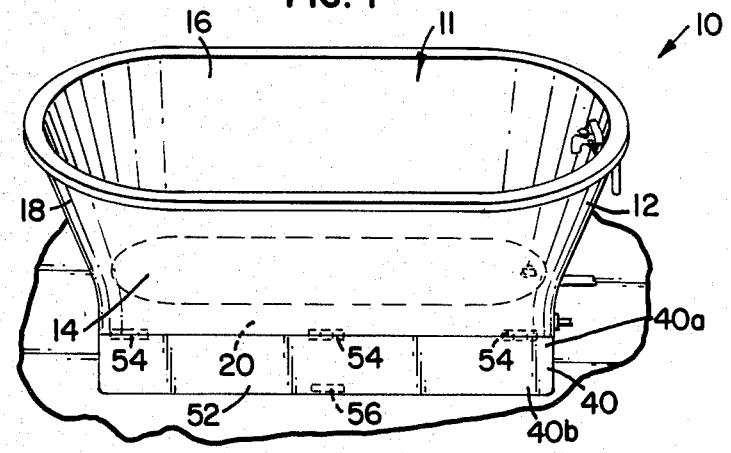
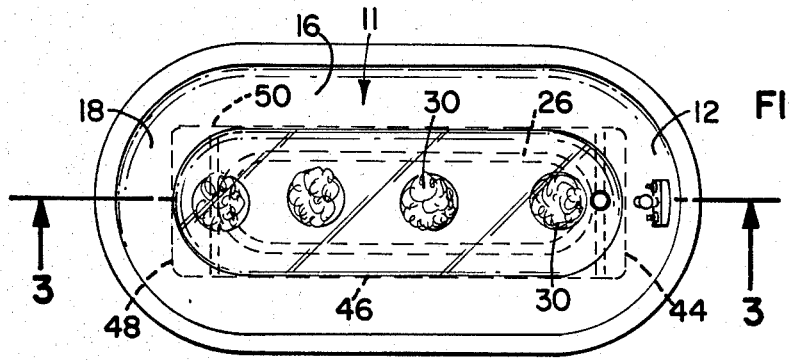
FIG. 2
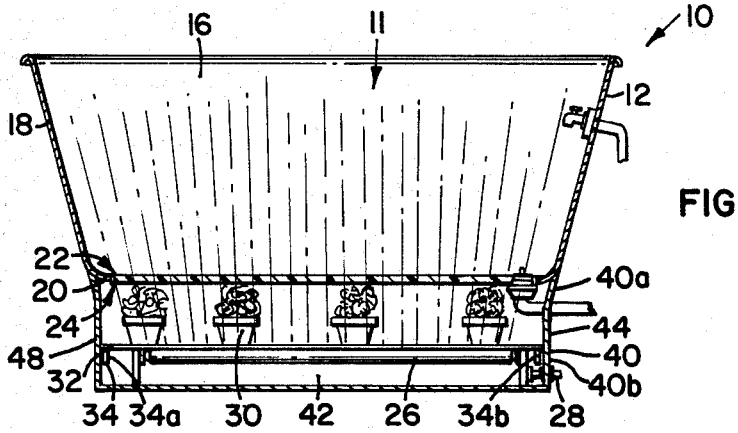
FIG. 3

DECORATIVE BATHTUB

The present invention relates generally to the field of bathing fixtures or bathtubs such as are generally utilized in the home. More particularly, this invention relates to a bathtub having decorative and safety features. These features include a transparent bottom surface of the bathing compartment, and positioned beneath that surface, a light source. Between the light source and the bottom surface of the bathing compartment is a decorative element such as a floral arrangement or seashells. The decorative element is preferably supported by a transparent or translucent tray which is slidable on a track for easy removal from beneath the bathing compartment.

BACKGROUND OF THE INVENTION

Baths of various kinds, ranging from Roman baths to jacuzzi tubs to the typical bathtub found in the home, have long been known. The bathtub can very simply provide a bathing compartment for a cleansing bath, or can provide features to appeal to aesthetics, such as swirling action of the water, an unusually shaped tub, or even an aquarium bath as disclosed in U.S. Pat. No. 4,364,132, wherein the sides of the bathing compartment form water-tight chambers for use as an aquarium visible to one bathing within the tub.

The present invention provides a bathtub having a highly decorative appearance to the bather, and a light source for viewing the decorative features and to provide added safety for the bather.

Decorative elements for a bathing fixture frequently include such features as cannot easily be changed. For example, the fixtures may be gold plated, brightly colored ceramic, crystal, or the like, in a variety of designs or shapes. The tub itself may be of a decorative shape, or may be formed of a colored or patterned material. Additionally, water resistant decals or stickers in the form of flowers, mushrooms, owls and the like can be applied to the surface of the tub. As previously mentioned, the tub may even include an aquarium portion. However, these known decorative features present many drawbacks. For example, decorative fixtures, once installed, can be expensive and inconvenient to replace, should the bather tire of them. The decals can be difficult to remove from the tub surface when a change of decoration may be desired. Additionally, the shape of the tub or the material from which it is formed, is generally a relatively permanent feature and cannot easily be altered to suit changing tastes or the whims of the bather.

As a separate matter, many tubs present difficulties to bathers such as children, elderly persons, or bathers of any age with poor eyesight. Bath accessories such as a bar of soap, wash cloth, shampoo bottle cap, or children's bath toys, can slip under the surface of the bath water and be difficult to locate and retrieve. Further, the bottom surface of the bathing compartment is not always clearly visible, making it difficult for some to enter or leave the bathing compartment safely.

The present invention provides a bathtub wherein the decorative elements can include items which typically are not used to decorate bathtubs, such as fresh flower arrangements, actual seashells or sand, or any three-dimensional object of an appropriate size which the bather would like to display as a portion of the bathing compartment. The bathtub includes a clear bottom surface, beneath which can be positioned the decorative items mentioned. In addition, the area beneath the clear bottom surface can include a light source. The light source can serve to illuminate the decorative elements. Additionally, the light source provides added convenience and safety for the bather, for example in retrieving objects which slip under the surface of the water, or in entering or leaving the bathtub.

SUMMARY OF THE INVENTION

The present invention relates to a bathtub having decorative features. The bathtub comprises a tub or bathing compartment having front, rear, and side walls. In addition, the tub has a transparent bottom wall having a top and bottom surface. The transparent bottom wall is positioned such that it can be illuminated from below. The bathtub further includes means for illuminating the transparent bottom wall from below.

The means for illuminating the transparent bottom wall is preferably a light or light source. This light can itself be considered a decorative element, or the bathtub can further include at least one other decorative element positioned so as to be visible through the top surface of the transparent bottom wall.

In a preferred embodiment, the bathtub further includes a transparent tray supporting the decorative element. The tray is preferably slideable on a track for removal from beneath the bottom surface.

In a preferred embodiment, the area beneath the bottom surface of the tub is fully enclosed by the same front, rear and side walls which comprise the bathing compartment or tub. One of these walls, preferably a side wall, includes a door beneath the transparent bottom surface, to provide access to the tray and allow easy arrangement or substitution of the decorative element or elements.

BRIEF DISCUSSION OF THE DRAWINGS

The invention will be better understood by reference to the drawings.

FIG. 1 is a perspective view of a decorative bathtub in accordance with the present invention.

FIG. 2 is a top view of the decorative bathtub illustrated in FIG. 1.

FIG. 3 is a view taken generally along line 3—3 of FIG. 2.

DETAILED DESCRIPTION OF THE INVENTION

Referring to the Drawings wherein like reference numerals denote like elements throughout the several views, there is shown in FIG. 1 a decorative bathtub 10. The bathtub includes a tub or bathing compartment 11 having walls or general areas designated as front wall 12, side walls 14 and 16, and rear wall 18.

The tub 11 further includes a transparent or translucent bottom wall 20. Bottom wall 20 includes a top surface 22 and a bottom surface 24. Bottom wall 20 is positioned such that it can be illuminated from below.

Bathtub 10 of this invention further comprises a means for illuminating bottom wall 20 of tub or bathing compartment 11, from below. Generally, this means comprises a light 26, located under or beneath bottom wall 20.

Front, rear and side walls 12, 18, 14 and 16 can be made of any suitable material such as molded plastic, fiberglass, ceramic, stainless steel, or the like. The material must of course be sufficiently nonporous to maintain the water within the tub, and must be strong enough to support the water which fills the tub. It is also envisioned that the material forming bathtub 10 could be decorative, for example, having a marbled appearance or a pleasing color.

The bathtub can be of any suitable shape. For aesthetic reasons, it is particularly envisioned that the interior surfaces of the bathtub would be of an oval shape, while the exterior surfaces could define an oval or a rectangular shape. As illustrated in the Drawings, the bathtub of this invention can have an oval shape near the top of the bathtub, with a more rectangular shape at the bottom end or base. It should be noted that the size and shape of the bathtub is not critical.

A means for illuminating the transparent or translucent bottom wall 20 of tub 11 is located under or beneath bottom wall 20. This means of illumination can be an incandescent light bulb, a fluorescent light bulb, a string of lights, a neon light tube, or the like. The light 26 can provide typical illumination such as is used in homes or offices, or can provide colored light or even light which changes colors. One preferred light source 26 would provide a ring of light positioned near the edge of the oval shape defined by the bottom wall 20 of the tub. This light is illustrated in the Figures. It is envisioned that such an oval shaped light ring can be custom-made, if necessary.

The light 26 can utilize any appropriate power source. For example, the light can be battery operated, or, as illustrated in FIG. 3, can include a cord 28 which can be plugged into an electric outlet, preferably one having a supplementary circuit breaker such as a ground fault interrupter or other safety feature.

Light 26 can be supported beneath bottom wall 20 of tub 11 by any suitable means such as an appropriate support or stand resting on the floor beneath the tub as illustrated in FIG. 3, or a support system extending from the sides of support base 40 for the tub, the support base 40 to be described hereinafter. It is also envisioned that light 26 could be suspended in place, for example, suspended from tray 32 which is described hereinafter.

Decorative bathtub 10 further includes at least one decorative element 30 positioned so as to be visible through top surface 22 of bottom wall 20. The decorative element 30 can be supported beneath bottom wall 20 in any suitable manner, such as those described for supporting light 26. The decorative element 30 generally will be a three-dimensional object such as a floral arrangement, sea shells, or any item at all which is of an appropriate size such that it can be positioned beneath bottom wall 20. It is also envisioned that the decorative element 30 can be merely a drawing or painting on the bottom surface 24 of bottom wall 20. The drawing or painting could be made with water color paints, water soluble inks, chalk or the like such that the decorative element could be easily removed or altered as desired.

Where decorative element 30 is a three-dimensional object, the invention preferably includes a transparent or translucent tray 32 positioned beneath bottom wall 20 and above light 26. It is envisioned that tray 32 will support decorative element 30, and will allow the decorative element to be back lit, as viewed from above through bottom wall 20. Tray 32 can be formed of any suitable transparent or translucent material such as plexiglass, plastic, or even glass, although it would be preferable to use tempered or other safety glass if glass is to be used.

Tray 32 preferably will be slideable on a track 34 for relatively easy removal from beneath bottom wall 20 of tub 11. The track 34 can be provided as a free standing unit or frame-like structure which rests on the floor beneath bottom wall 20 of tub 11. Alternatively, the track can be provided in any suitable manner. Preferably, track 34 will be mounted on support base 40, to be described hereinafter.

Tub or bathing compartment 11 will be supported in some fashion above light source 26. Such support can be provided in a number of ways. For example, the bathing compartment 11 can be mounted to a wall, leaving room beneath the bathing compartment for the light source 26, decorative element 30, and the like. It is also envisioned that tub 11 could be mounted on legs or other pole-like supports to provide an area beneath bottom wall 20 of tub 11. In a preferred embodiment, as illustrated in the Figures, the tub or bathing compartment 11 will be attached or connected to a support base 40 having an upper end **40*a* which is closer to bottom wall 20 and a lower end 40*b* which is closer to the floor. Support base 40 defines an area generally designated as 42, beneath bathing compartment 11**.

Support base 40 includes at least one wall and is preferably fully enclosed by such walls. In a preferred embodiment the support base is rectangularly shaped and includes walls 44, 46, 48, and 50. Where the support base is rectangularly shaped, walls 46 and 50 can be the longer side walls, while walls 44 and 48 can be the shorter end walls. The tub 11 can be mounted on support base 40 by any known means. Preferably, walls 44, 46, 48 and 50 will be extensions of the sides of tub 11, being formed of the same material.

A wall of the support base preferably includes a door 52 to provide access to area 42 beneath bathing compartment 11. Preferably, the door will be along one of the longer walls 46 or 50 so as to provide easier access to area 42. Additionally, preferably door 52 will encompass an entire side of the support base, and will include hinges 54 and closures 56 mounted so as not to be visible from a perspective view of the bathtub 10 when door 52 is closed. Thus, the door itself will appear to be no more than a side of the support base 40, as it appears in FIGS. 1 and 3. It is envisioned that closure 56 could be a known magnetic-type closure. Preferably, door 52 will be mounted with appropriate hardware so as to spring open when pressure is applied, as is known. In this way no handle or knob would be required, although other ways of opening the door, for example using a handle, could of course be provided.

Tray 32 is positioned substantially horizontally within area 42 beneath bathing compartment 11. Preferably, tray 32 is positioned between bottom wall 20 of tub 11 and the lower end **40*b* of support base 40**.

Tray 32 has been previously described. Preferably, tray 32 will be slideable on a track 34 for relatively easy removal from beneath the bottom wall 20 of tub 11. Track 34 can comprise track portion **34*a* and track portion 34*b*, as illustrated in FIG. 3. These track portions can be in the nature of rails mounted substantially horizontally opposite each other along walls 44 and 48 of support base 40. Track portions 34*a* and 34*b* can be simple strips of wood, metal, or other suitable material mounted by way of adhesives, screws, or any other appropriate means. Tray 32 can rest on and be supported by rails 34*a* and 34*b*. It is also envisioned that track portions 34*a* and 34*b* can be designed to engage the edge of tray 32** in a manner known in the art, to provide better slideability and stability for the tray.

Obviously numerous modifications and variations of the present invention are possible in the light of the above teachings. It is therefore to be understood that within the scope of the appended claims the invention may be practiced otherwise than as specifically described therein.

I claim:

1. An elevated bathtub comprising:

(a) a tub having front, rear, and side walls, and a transparent bottom wall having a top and bottom surface, the transparent bottom wall being positioned such that the bottom wall can be illuminated from below;

(b) means for illuminating the transparent bottom wall from below; and (c) means for gaining access to the area beneath the transparent bottom wall so as to permit placement, removal and rearrangement of any articles contained therein.

2. The bathtub of claim 1 wherein the illuminating means is a light located under the transparent bottom wall.

3. The bathtub of claim 2 further including at least one decorative element positioned so as to be visible through the top surface of the transparent bottom wall.

4. A bathtub comprising:

(a) a tub having front, rear, and side walls, and a transparent bottom wall having a top and bottom surface, the transparent bottom wall being positioned such that the bottom wall can be illuminated from below;

(b) means for illuminating the transparent bottom wall from below, wherein the illuminating means is a light located under the transparent bottom wall;

(c) at least one decorative element positioned so as to be visible through the top surface of the transparent bottom wall; and (d) a transparent tray positioned beneath the bottom wall and above the light, the tray supporting the decorative element.

5. The bathtub of claim 4 wherein the tray is slidable on a track for removal from beneath the bottom wall.

6. A bathtub comprising:

(a) a bathing compartment having four side walls and a transparent bottom wall;

(b) attached to the bathing compartment, a support base having an upper end and a lower end, the support base defining an area beneath the bathing compartment, the support base having at least one wall, the wall having a door to provide access to the area beneath the bathing compartment;

(c) a tray positioned substantially horizontally within the area beneath the bathing compartment, the tray being positioned between the bottom wall of the bathing compartment and the lower end of the support base;

(d) within the area beneath the bathing compartment, a light source.

7. The bathtub of claim 6 wherein the tray is translucent, and wherein the light source is positioned beneath the tray, between the tray and the lower end of the support base.

8. The bathtub of claim 7 wherein the tray is slidably mounted on a track installed within the support base.

9. The bathtub of claim 8 further comprising at least one decorative element supported by the tray and located between the tray and the bottom wall of the bathing compartment.

* * * * *